US010870031B2

(12) United States Patent
Bartolotta

(10) Patent No.: US 10,870,031 B2
(45) Date of Patent: Dec. 22, 2020

(54) HIP FLEXOR BENCH

(71) Applicant: Nicolas Andrew Bartolotta, Venice, CA (US)

(72) Inventor: Nicolas Andrew Bartolotta, Venice, CA (US)

( * ) Notice: Subject to any disclaimer, the term of this patent is extended or adjusted under 35 U.S.C. 154(b) by 0 days.

(21) Appl. No.: 16/412,412

(22) Filed: May 14, 2019

(65) Prior Publication Data

US 2019/0344116 A1 Nov. 14, 2019

Related U.S. Application Data

(60) Provisional application No. 62/670,869, filed on May 14, 2018.

(51) Int. Cl.
*A63B 21/00* (2006.01)
*A63B 23/04* (2006.01)

(52) U.S. Cl.
CPC ..... *A63B 21/4029* (2015.10); *A63B 23/0482* (2013.01); *A63B 2225/09* (2013.01)

(58) Field of Classification Search
CPC .... A61H 1/0259; A61H 1/0255; A63B 21/00; A63B 21/012; A63B 21/4029; A63B 21/055; A63B 21/0058; A63B 21/06; A63B 26/00; A63B 2069/0062; A63B 23/0482; A63B 23/02; A63B 71/0622; A63B 2220/80; A63B 2220/51; A63B 2225/093; A63B 2210/06; A63B 2208/0252
USPC ..... 482/142
See application file for complete search history.

(56) References Cited

U.S. PATENT DOCUMENTS 4,691,918 A * 9/1987 Rockwell ..... A63B 21/00 482/133
5,611,770 A * 3/1997 Tesch ..... A61H 1/0266 482/131
7,488,280 B2 * 2/2009 Arsenault ..... A63B 21/0601 482/140
7,575,539 B2 * 8/2009 Kessler ..... A63B 21/0083 482/112
10,343,005 B2 * 7/2019 Splane, Jr. ..... A63B 7/00
2008/0032877 A1 * 2/2008 Denisco ..... A63B 26/00 482/145
2009/0264265 A1 * 10/2009 Contreras ..... A63B 21/00047 482/99
2011/0009249 A1 * 1/2011 Campanaro ..... A63B 21/4043 482/131
2014/0194266 A1 * 7/2014 Raiten ..... A63B 21/4011 482/142
2016/0184629 A1 * 6/2016 Hornback ..... A63B 21/00065 482/98
2016/0346581 A1 * 12/2016 Splane, Jr. ..... A63B 21/015
2017/0348170 A1 * 12/2017 Keepers ..... A61H 1/00

* cited by examiner

*Primary Examiner* — Andrew S Lo
*Assistant Examiner* — Thao N Do
(74) *Attorney, Agent, or Firm* — Heidi Eisenhut; Loza & Loza, LLP

(57) ABSTRACT

The present disclosure relates to an apparatus or bench to provide the contralateral stability required for performing such exercises and therapeutic techniques on the Psoas and Illiacus muscles (Primary Hip Flexors) of an individual.

12 Claims, 10 Drawing Sheets

FIG. 4
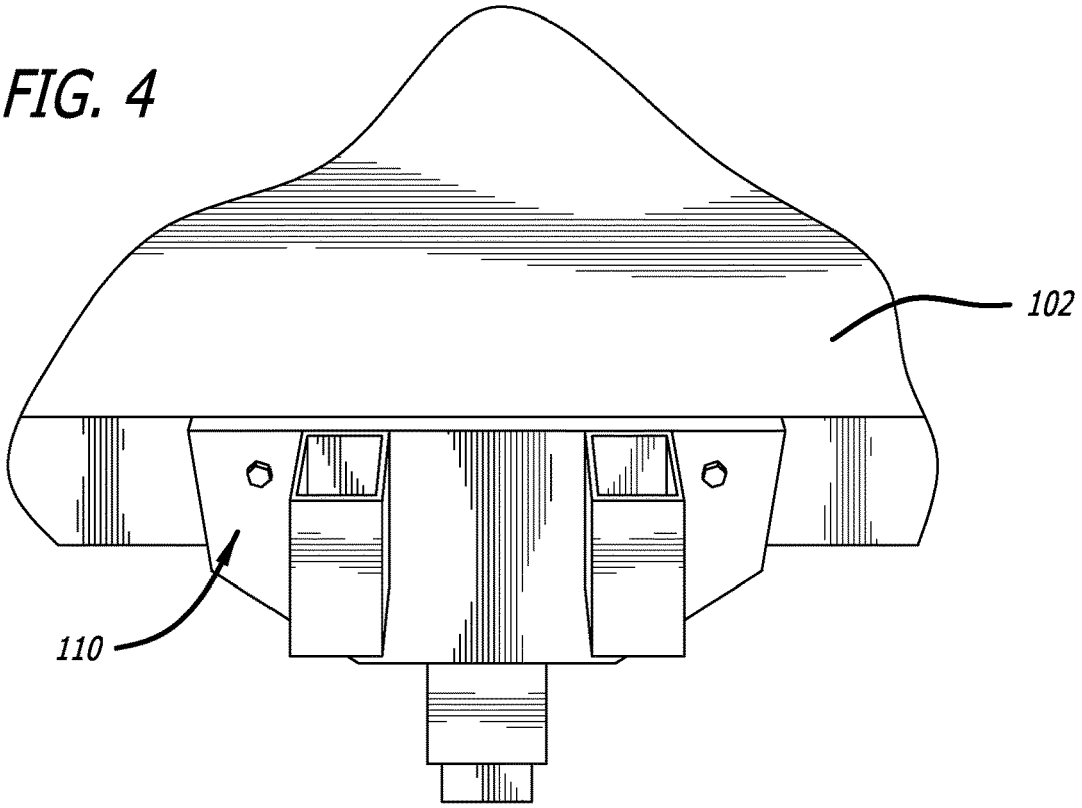
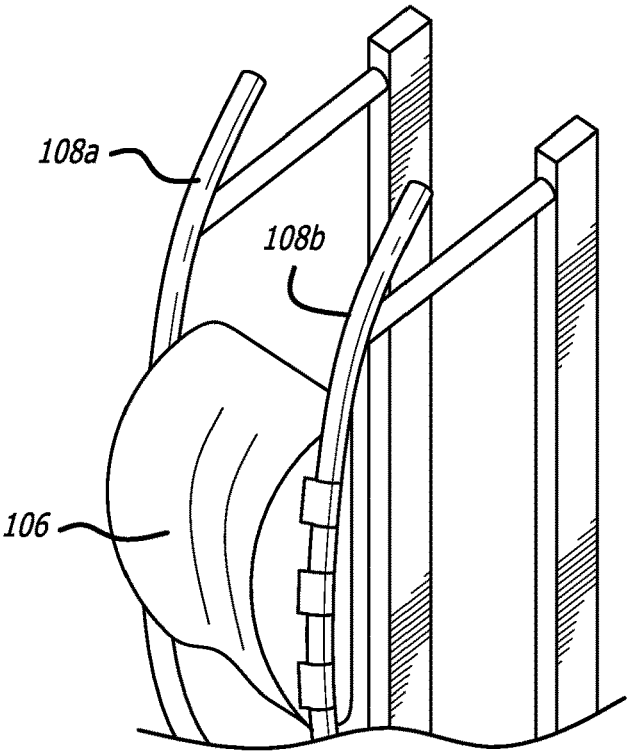
FIG. 5

HIP FLEXOR BENCH

FIELD

The present disclosure relates to an apparatus or bench to provide the contralateral stability required for performing such exercises and therapeutic techniques on the Psoas and Illiacus muscles (Primary Hip Flexors) of an individual.

BACKGROUND

The primary hip flexors of an individual as a muscle group consist of the Psoas Major & Minor, and the illiacus muscles (referred to together as the illiopsoas). The secondary hip flexors include the Rectus Femoris and the Tensor Fascia Latta (TFL). The Psoas muscle including the fibers that join with the Illiacus muscle is the only muscle in the human body that originates on the spine and inserts (attaches) to the lower body via the lesser trochanter of the Femur. This unique feature of the anatomy of the psoas muscle makes it impossible to isolate for exercise/therapy without a very specific position that creates true contralateral stabilization of the lumbar spine. In fact, there is only 1 position that can be used to create the adequate stability and leverage needed to perform isolated muscle contractions (strength training & resistance stretching) using the primary hip flexors.

In view of the above, an apparatus or bench is needed to provide the contralateral stability required for performing such exercises and therapeutic techniques on the Psoas and Illiacus muscles (Primary Hip Flexors).

SUMMARY

The present application is directed to a hip flexor bench. The hip flexor bench may comprise a horizontal surface; a mounting system secured to an end of the horizontal surface; and a leg stabilization structure detachable secured to mounting system. The leg stabilization structure may comprise a base; a first vertical support member extending upwardly from the base; a second vertical support member parallel to first vertical support member and extending upwardly from the base; a first horizontal member integrally connected to and extending perpendicularly outward from a first end of the first vertical support member; a second horizontal member integrally connected to and extending perpendicularly outward from a first end of the second vertical support member; a first rail integrally connected to the first horizontal member and the first vertical support member; a second rail integrally connected to the second horizontal member and the second vertical support member; and a pad detachably secured to the first and second rails.

According to one aspect, the first and second rails have an arcuate shape.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

FIG. 4 shows a mounting system for mounting a Hip Flexor Bench to a surface, according to aspects of the disclosure described herein.

FIG. 5 is a partial view of a Hip Flexor Bench showing a front, right perspective view of a rail system and leg stabilization structure, according to aspects of the disclosure described herein.

DETAILED DESCRIPTION

Figure 1:
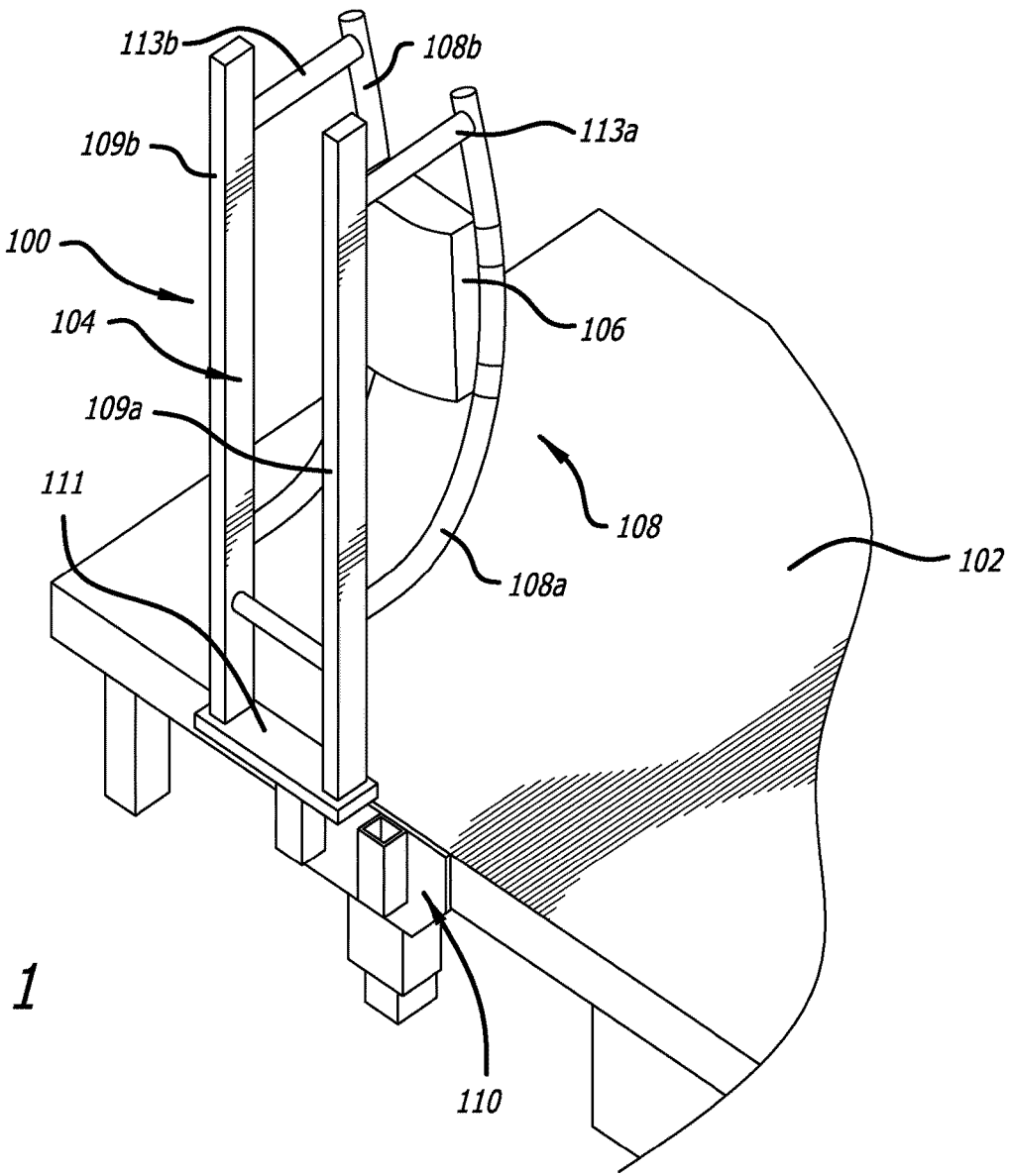
FIG. 1 shows a back side perspective view of a Hip Flexor Bench, according to aspects of the disclosure described herein.
Figure 2:
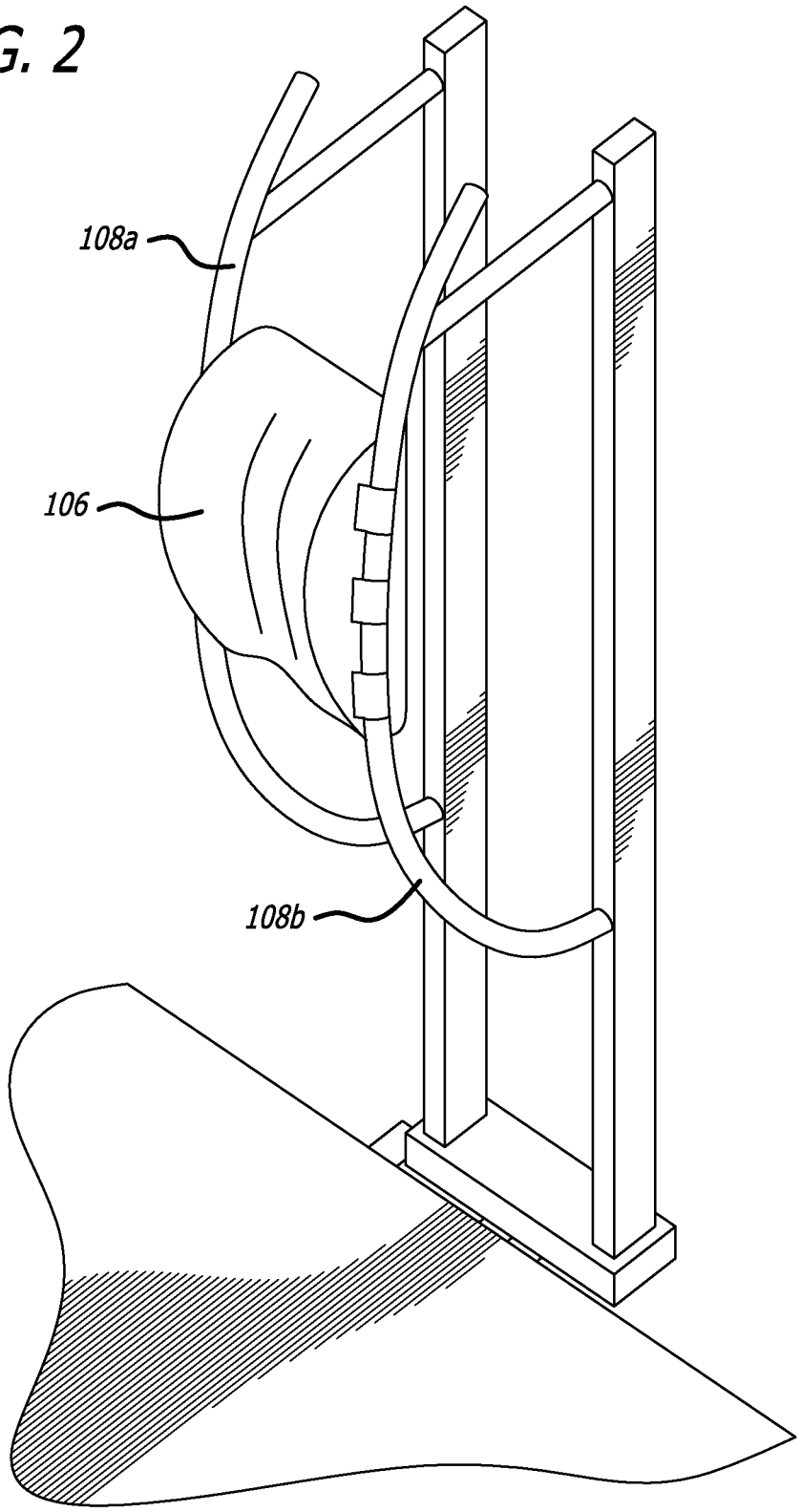
FIG. 2 shows a front side perspective view of a Hip Flexor Bench, according to aspects of the disclosure described herein.

In the following description, specific details are given to provide a thorough understanding of the embodiments. However, it will be understood by one of ordinary skill in the art that the embodiments may be practiced without these specific details.

Overview

As discussed above, the primary hip flexors as a muscle group consist of the Psoas Major & Minor, and the illiacus muscles (referred to together as the illiopsoas). The secondary hip flexors include the Rectus Femoris and the Tensor Fascia Latta (TFL). The Psoas muscle including the fibers that join with the Illiacus muscle is the only muscle in the human body that originates on the spine and inserts (attaches) to the lower body via the lesser trochanter of the Femur. This unique feature of the anatomy of the psoas muscle makes it impossible to isolate for exercise/therapy without a very specific position that creates true contralateral stabilization of the lumbar spine. In fact, there is only 1 position that can be used to create the adequate stability and leverage needed to perform isolated muscle contractions (strength training & resistance stretching) using the primary hip flexors. The present disclosure of the Dynamic Contraction Technique (DCT) Hip Flexor Bench (or just hip flexor bench) overcomes these problems and provides the contralateral stability required for performing such exercises and therapeutic techniques on the Psoas and Illiacus muscles (Primary Hip Flexors).

Specific Biomechanics of the Primary Hip Flexors (Psoas & Illiacus)

The Origin of the Psoas muscle is the anterior lateral aspect of all 5 vertebral bodies of the lumbar spine. Almost every other muscle in the human body has an origin on one bone crossing only 1-2 joints. The Psoas originates on 5 separate bones and crosses 5 distinct vertebral joints before crossing a 6th joint, the hip joint, on which the primary action of this muscle takes place. This unique multi joint origin creates an extreme level of instability that has not been addressed by any existing Exercise and/or Therapeutic strength training equipment. Current technology for isolating the Hip Flexors utilize improper ergonomics by attempting to apply a unilateral resistance without creating adequate contralateral stabilization to the lumbar spine. For example, conventional apparatus that are used to the standing resting knee exercise.

On this existing conventional apparatus, an individual stands on one leg and lifts his/her opposite leg up into a weighted rotary arm bending their knee as they do so to create hip flexion. The opposite leg in this exercise is in a neutral hip position and leaves the lumbar spine with almost no stabilization such that isolation of the Illiopsoas is impossible. The natural tendency when using this body position for hip flexion is for the lumbar to be pulled forward and down creating an arch in the lower back (hyperlordosis). This results in a compensatory activation of the abdominals and a posterior tilt of the pelvis by the user to avoid injury. The compensation is what nullifies the machine's ability to isolate and adequately exercise the hip flexors.

Biomechanics of the Hip Flexors—How Counterforce Stabilizes the Origin of a Muscle that is Anatomically Unstable The origin of the Psoas crosses 5 separate joints of the spine making it inherently unstable. In dynamic movement the Psoas is an effective Hip Flexor due to the natural counter forces created by the antagonist muscle groups of the opposite leg. e.g. Running. As Hip Flexion occurs on one leg, hip extension creates an equivalent counterforce on the other leg. Without a significant enough extensor force occurring at the same time as the hip flexion demand, the lumbar will become unstable and the body will compensate by recruiting lumbar extensors and secondary hip flexors such as the abdominals, rectus femoris, and the TFL. Isolation of the Primary Hip Flexors is impossible without adequate counterforce of opposite leg extensors.

Unique/Novel Ergonomics and Function of the Hip Flexor Bench

Figure 3:
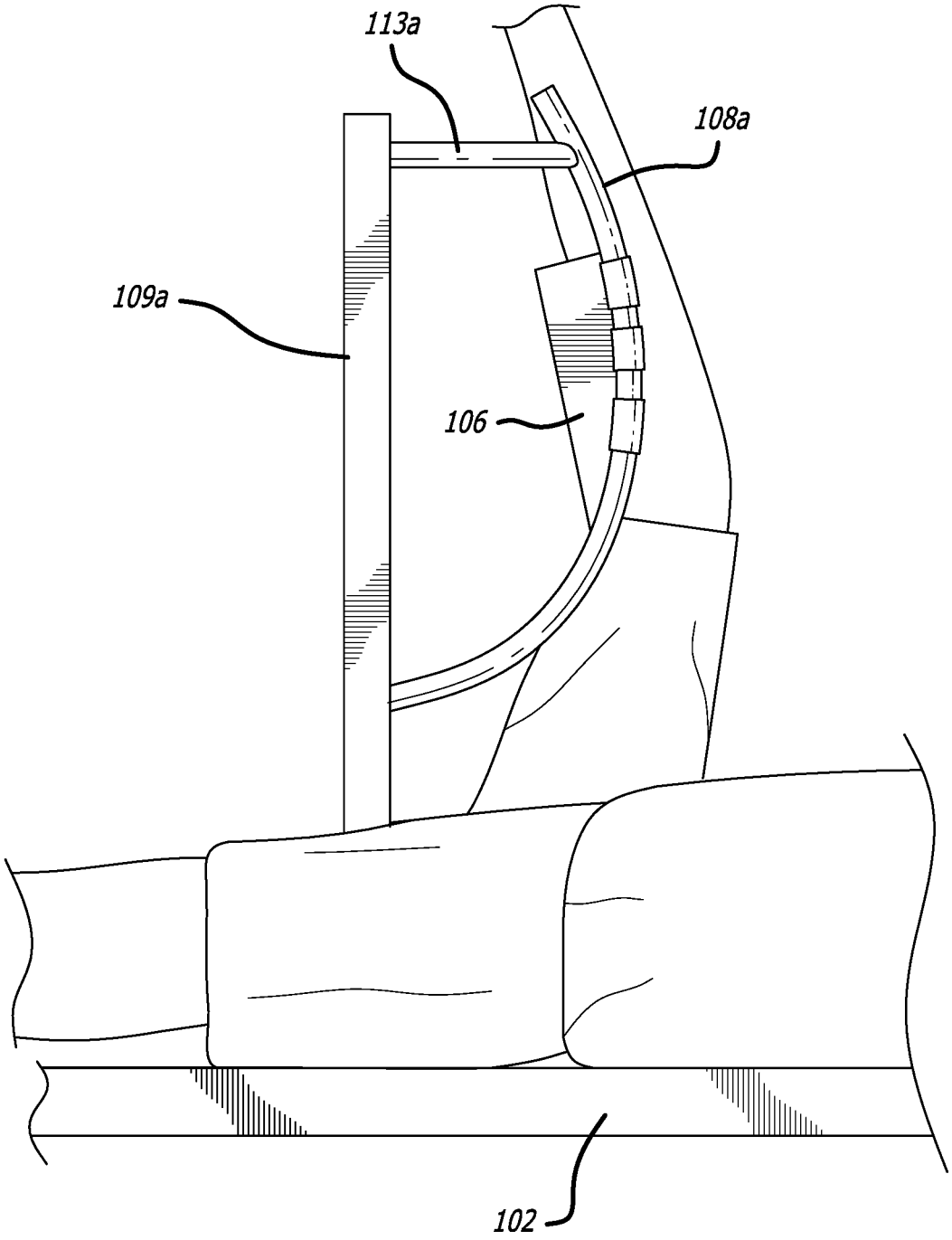
FIG. 3 shows an individual with a leg in the stabilizing leg cradle of a Hip Flexor Bench, according to aspects of the disclosure described herein.

In order to stabilize the lumbar spine for isolated Hip Flexor exercise/resistance stretching the user must be in a supine position with their opposite leg held in Hip Flexion at or above 90 degrees. (See FIG. 3) This is called "contralateral stabilization." By locking the opposite leg into Hip Flexion we directly restrict motion of the lumbar spine. This position forces the raised leg that is locked in Hip Flexion to activate the hip extensors to provide leverage for the illiopsoas of the target limb to contract both concentrically and eccentrically without causing compensatory muscle activity. Furthermore, the contralateral force gives stability to the lumbar spine during the activity and allows for true isolation of the illiopsoas during hip flexion.

Specific Design and Features of the Hip Flexor Bench

Figure 6:
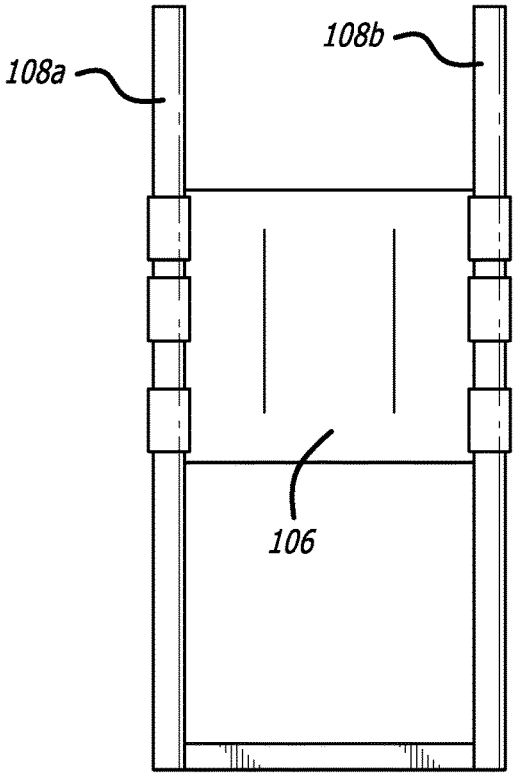
FIG. 6 is a partial view of a Hip Flexor Bench showing a back elevation view of a rail system and leg stabilization structure, according to aspects of the disclosure described herein.
Figure 7:
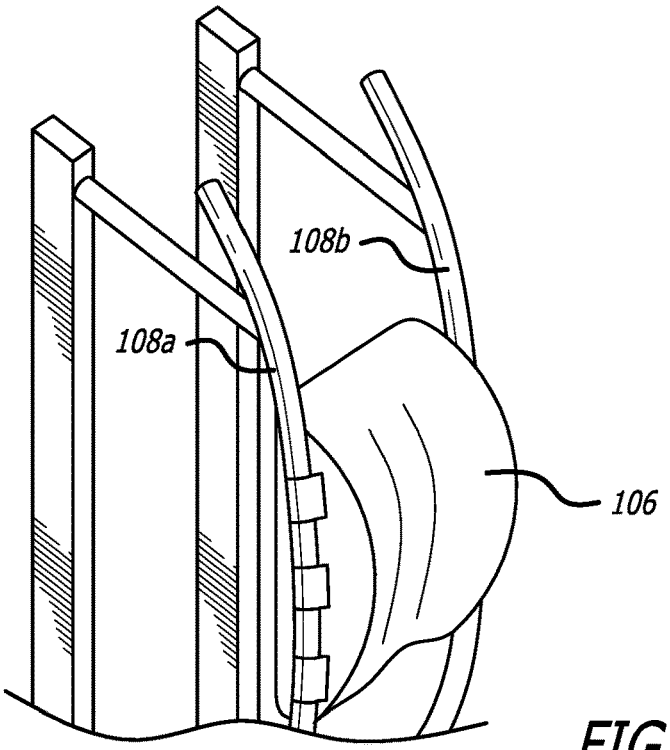
FIG. 7 is a partial view of a Hip Flexor Bench showing a front, left perspective view of a rail system and leg stabilization structure, according to aspects of the disclosure described herein.

The Hip Flexor Bench 100 of the present disclosure may be comprised of a surface 102 that is wide enough and long enough for a user to lay on in a supine position. The bench surface 102 is raised at an adequate distance to allow for a user's leg to move below the surface of the bench. According to one aspect, attached to the bench surface 102 is an ergonomically designed leg stabilization structure 104 that is designed to support and arrest one of the user's legs such that their hip is held statically at close to a 90 degree angle for the purpose of performing contralateral exercise on the opposite leg. (See FIG. 3) The leg stabilization structure or leg stabilization cradle 104 may include a pad 106 (See FIGS. 5-7) that is also ergonomically designed to cradle the user's raised leg comfortably supporting their posterior knee. The stabilization pad can be adjusted up and down on a rail system 108 incorporated into the leg stabilization structure 104 and can be locked at a specific height to accommodate a full range of user leg lengths and hamstring flexibility limitations. The rail system 108 may include a pair of elongated members 108*a*, 108*b*, having a curved or arcuate configuration, integrally secured to a first vertical support member 109*a* and a second vertical support member 109*b*, respectively. The first and second vertical support members 109*a*, 109*b* may be parallel and extend upwardly from a base 111. A first horizontal member 113*a* may extend perpendicularly outwardly from the first vertical member 109*a* and a second horizontal member 113*b* may extend perpendicularly outward from the second vertical member 109*b*. The first and second horizontal members 113*a*, 113*b* may be parallel. As shown, the first rail 108*a* in the pair of rails may be integrally connected to the first horizontal member 113*a* at a first end and the first vertical member 109*a* at a second end while the second rail in the pair of rails may be integrally connected to the second horizontal member 113*b* at a first end and the second vertical member 109*b* at a second end. The entire leg stabilization structure 104 can be removed from the Hip Flexor Bench surface if needed for entry or exit of the user from the bench and the leg stabilization structure can be moved side to side on the bench to allow for proper alignment when using the device to target the opposite leg.

When being used for manual resistance performed by a trainer or therapist, the Hip Flexor Bench can be incorporated into any table surface via an adequate mounting system 110, or it can be incorporated into a mobile table system such as a dolly or wheeled table allowing for easy and convenient transport of the entire device. With the manual resistance variation of the Hip Flexor Bench, the contralateral resistance is provided by a human being positioned such that they can give resistance to the non-stabilized leg of the user. Resistance is given during, concentric, isometric and eccentric movements of the non-stabilized leg creating a strength training and resistance stretching effect on the hip flexors of the user.

Figure 8:
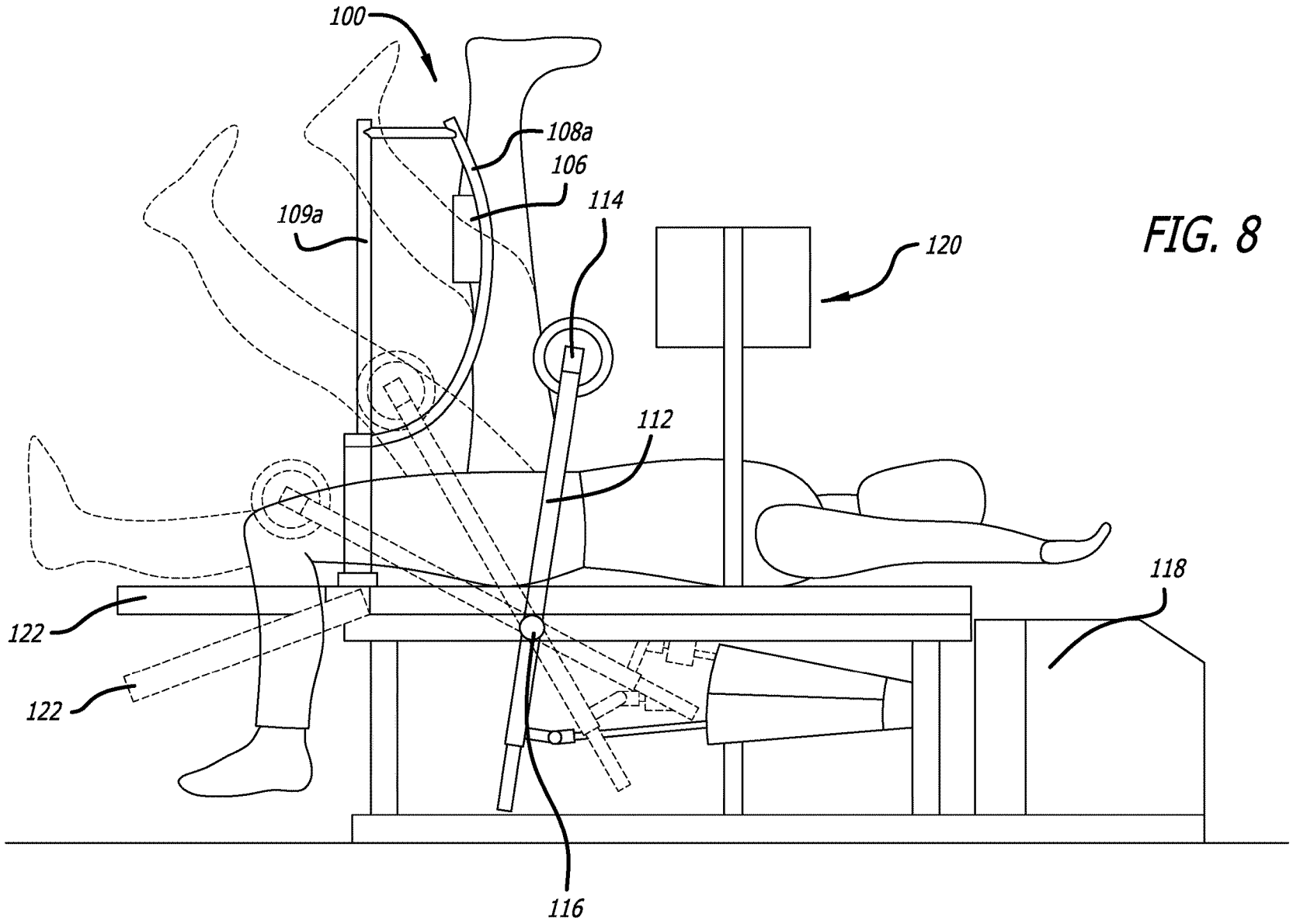
FIG. 8 shows a side elevation view of a Hip Flexor Bench having an adjustable/removable movement arm, according to aspects of the disclosure described herein.
Figure 9:
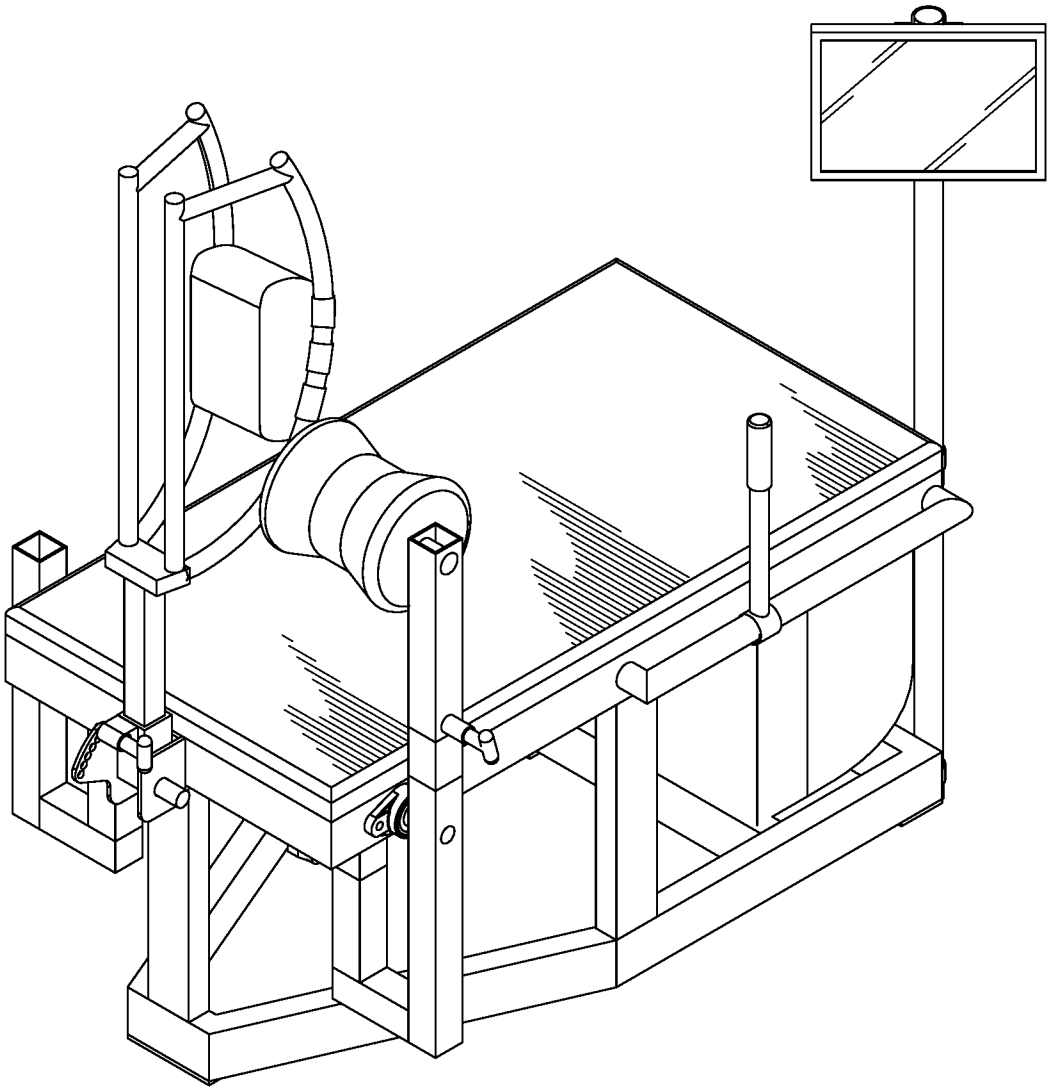
FIG. 9 shows a back side perspective view of a Hip Flexor Bench having an adjustable/removable movement arm, according to aspects of the disclosure described herein.
Figure 10:
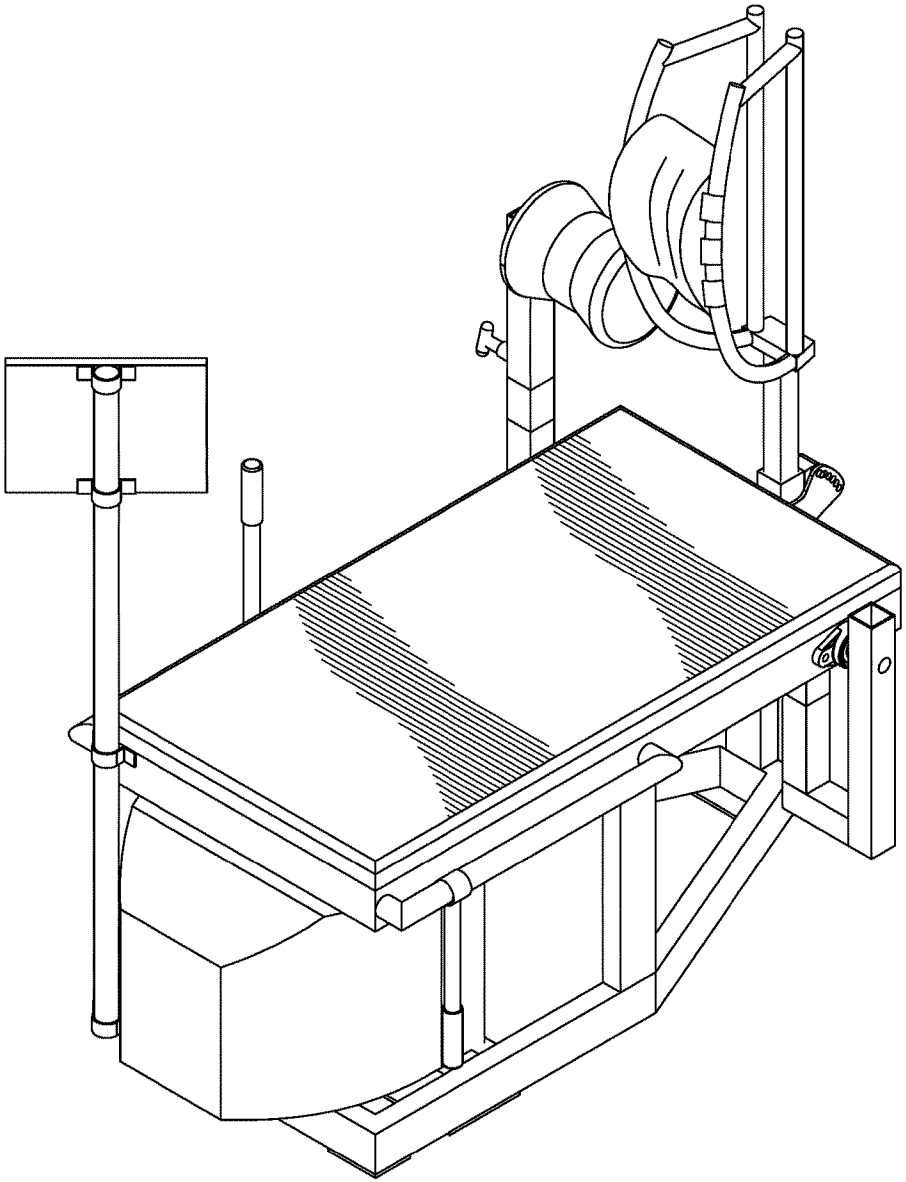
FIG. 10 shows a front side perspective view of a Hip Flexor Bench having an adjustable/removable movement arm, according to aspects of the disclosure described herein.
Figure 11:
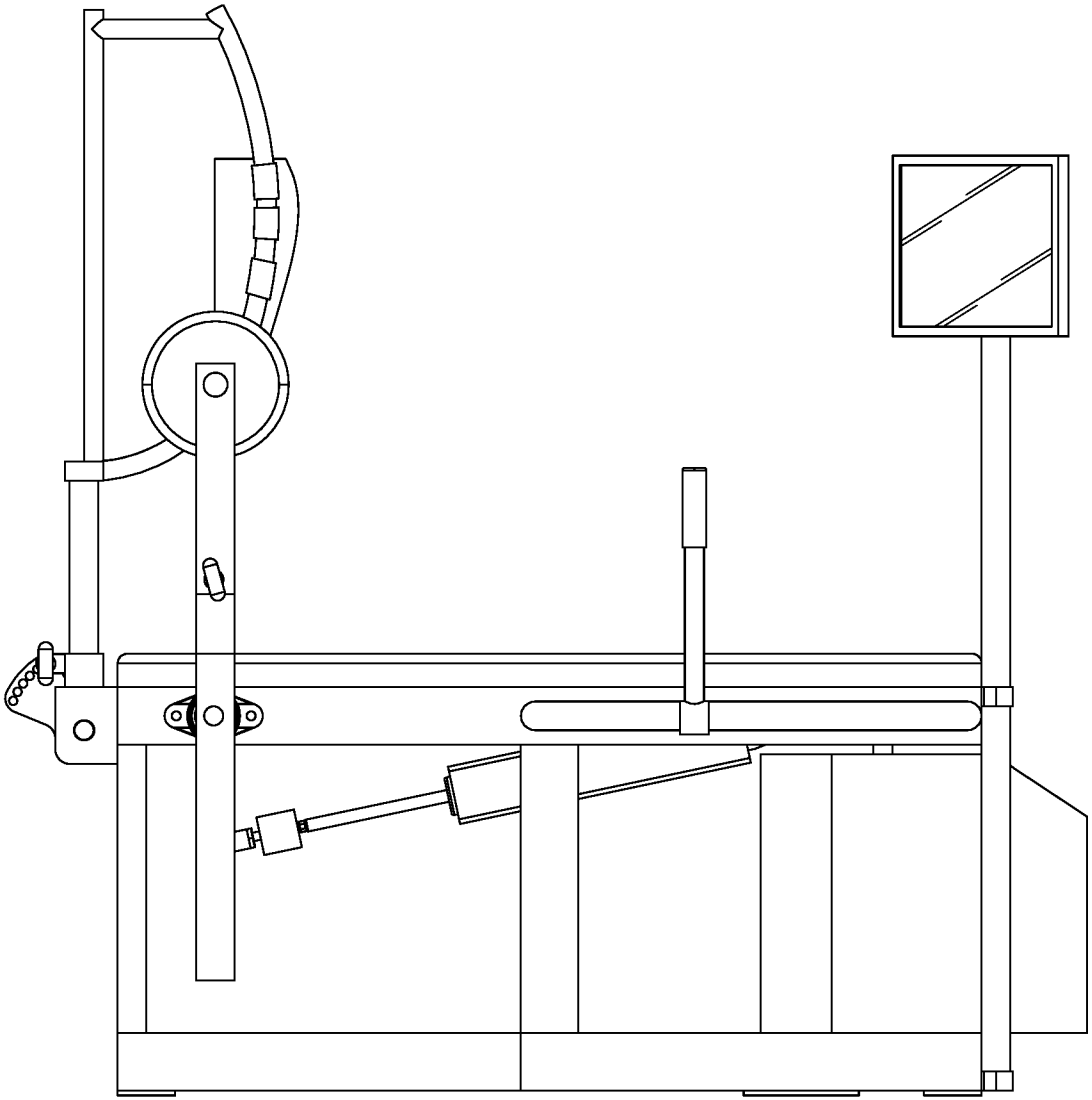
FIG. 11 shows a side elevation view of a Hip Flexor Bench having an adjustable/removable movement arm in a first position, according to aspects of the disclosure described herein.
Figure 12:
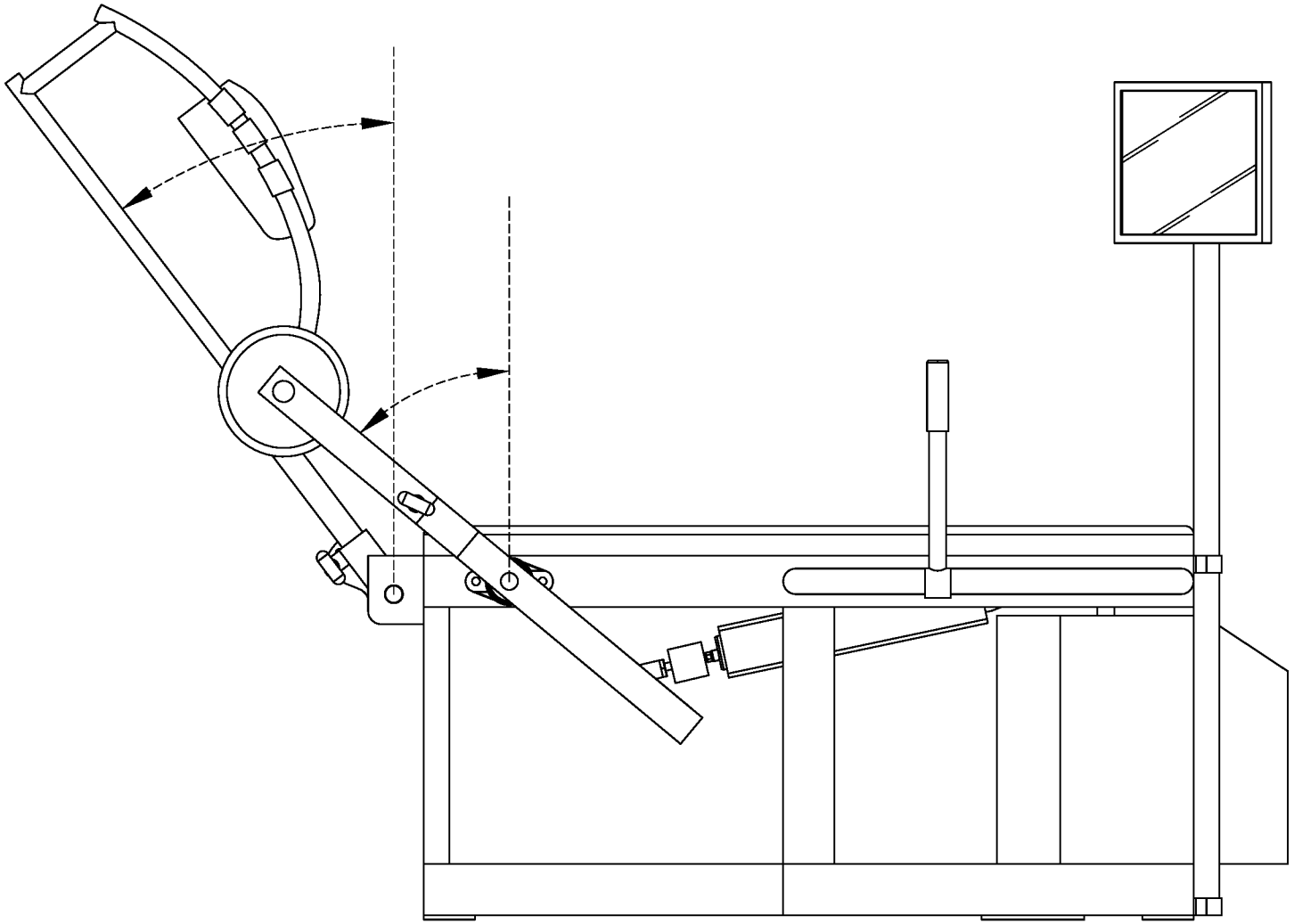
FIG. 12 shows a side elevation view of a Hip Flexor Bench having an adjustable/removable movement arm in second position, according to aspects of the disclosure described herein.

FIG. 8 shows a side elevation view of a Hip Flexor Bench having an adjustable/removable movement arm, according to aspects of the disclosure described herein. FIG. 9 shows a back side perspective view of a Hip Flexor Bench having an adjustable/removable movement arm, according to aspects of the disclosure described herein. FIG. 10 shows a front side perspective view of a Hip Flexor Bench having an adjustable/removable movement arm, according to aspects of the disclosure described herein. FIG. 11 shows a side elevation view of a Hip Flexor Bench having an adjustable/removable movement arm in a first position, according to aspects of the disclosure described herein. FIG. 12 shows a side elevation view of a Hip Flexor Bench having an adjustable/removable movement arm in second position, according to aspects of the disclosure described herein. The following discussion refers interchangeably to FIGS. 8-12.

According to another aspect of the present disclosure, the Hip Flexor Bench may further comprise an additional component that allows any non-human resistance to be applied to the non-stabilized leg. For example, the Hip Flexor Bench may further comprise a movement arm 112 with a cylindrical foam pad (or resistance pad) 114 that contacts the user's leg just above the knee. The resistance pad 114 spins on the movement arm 112 allowing it to rotate as needed as the leg moves from a hip extended position to a hip flexed position or vice versa against the resistance being provided. The resistance pad 114 on the movement arm 112 can also be adjusted up or down and locked at a specific height given the length of user's leg. The movement arm 112 itself may be fixed to the bench using hinges (for example) 116 such that when the movement arm 112 is forced to rotate by the external non-human resistance it follows the precise biomechanical arc of the movement of the user's non-stabilized hip. The movement arm 112 can also be moved by an automated motor 118 or any other form any form of non-human resistance known in the art, including but not limited to, weights and resistance bands. The movement arm 112 may be adjustable, as discussed above, as well as removable. The movement arm 112 be removably attached to the either side of the bench to allow the movement arm 112 to be utilized with both the left leg and the right leg of the user. As shown in FIG. 12, the movement arm 112 and the leg stabilization structure or cradle 104 may rotated and locked into position at any angle. A pull pin 130 at the base of the leg stabilization structure or cradle 104 and a pull pin 132 on the movement arm 112 may be utilized to adjust the angles of the movement arm 112 and the leg stabilization structure or cradle 104.

According to another aspect of the present disclosure, the Hip Flexor Bench that utilizes non-human resistance may be an automated motor 118 and biofeedback system that includes a user interface 120 to allow for coaching of a user through contralateral hip flexor strengthening and resistance stretching exercises. The biofeedback system comprises a load sensor and computer monitor or visual feedback device that utilizes algorithms to interpret a user's force at any given range of motion along the path of hip extension or flexion of the non-stabilized leg. This data can be interpreted into a user interface software and then stored to inform future use of the device specific to a user. (See FIGS. 8-12)

According to another aspect of the present disclosure, the hip flexor bench may further include one or more leg extension platforms 122 (See FIG. 8) that may be detachably secured to an end of the bench and may be moveable between a first position, which is in the same horizontal plane as the bench surface 102, and a second position which is may be angled downward.

According to another aspect of the present disclosure, the Hip Flexor Bench may include a first adjustable handle 134 and a second adjustable handle 136. The first and second handles 134, 136 may extend perpendicularly upward (see first handle in FIG. 8) or perpendicularly downward (see second handle in FIG. 8). Although shown in perpendicular positions, the handles may be adjusted to different angles. The first and second handles 134, 136 may be used by the user to provide leverage.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A hip flexor bench, comprising:

an elongated horizontal surface adapted to hold a user in a supine position;

a mounting system secured to an end of the elongated horizontal surface; and a detachable leg stabilization structure detachably secured to the mounting system, wherein the leg stabilization structure comprises:

a base;

a first vertical support member extending upwardly from the base;

a second vertical support member parallel to first vertical support member and extending upwardly from the base;

a first horizontal member integrally connected to and extending perpendicularly outward from a first end of the first vertical support member;

a second horizontal member integrally connected to and extending perpendicularly outward from a first end of the second vertical support member;

a first rail integrally connected to the first horizontal member and the first vertical support member;

a second rail integrally connected to the second horizontal member and the second vertical support member; and a pad detachably secured to the first and second rails; and a movement arm partially rotatable relative to the elongated horizontal surface; the movement arm configured to support a posterior knee of the second leg of the user.

2. The hip flexor bench of claim 1 wherein the first and second rails have an arcuate shape.

3. The hip flexor bench of claim 1 wherein the leg stabilization structure is adapted to provide contralateral stabilization to a lumbar spine of the user.

4. The hip flexor bench of claim 1 wherein the elongated horizontal surface is stationary.

5. The hip flexor bench of claim 1 wherein the leg stabilization structure is adapted to maintain a first leg of the user in a static position while allowing a second leg of the user to dynamically move.

6. The hip flexor bench of claim 1 wherein the first rail and the second rail extend in vertical planes.

7. A hip flexor bench, comprising:

an elongated stationary horizontal surface adapted to hold a user in a supine position;

a mounting system secured to an end of the elongated horizontal surface; and a detachable leg stabilization structure detachably secured to the mounting system, the leg stabilization structure comprising:

a base extending parallel along the end of the elongated horizontal surface;

a first vertical support member extending upwardly from the base;

a second vertical support member parallel to first vertical support member and extending upwardly from the base;

a first horizontal member integrally connected to and extending perpendicularly outward from a first end of the first vertical support member;

a second horizontal member integrally connected to and extending perpendicularly outward from a first end of the second vertical support member;

a first rail integrally connected to the first horizontal member and the first vertical support member, the first rail extending in a first vertical plane;

a second rail integrally connected to the second horizontal member and the second vertical support member, the second rail extending in a second vertical plane; and a pad detachably secured between to the first and second rails and adapted to receive a leg of the user; and a movement arm partially rotatable relative to the elongated horizontal surface, the movement arm configured to support a posterior knee of the second leg of the user; and wherein the leg stabilization structure is adapted to provide contralateral stabilization to a lumbar spine of the user.

8. The hip flexor bench of claim 7 wherein the first and second rails have an arcuate shape.

9. The hip flexor bench of claim 7 wherein the leg stabilization structure is adapted to provide contralateral stabilization to a lumbar spine of the user.

10. The hip flexor bench of claim 7 wherein the elongated horizontal surface is stationary.

11. The hip flexor bench of claim 7 wherein the leg stabilization structure is adapted to maintain a first leg of the user in a static position while allowing a second leg of the user to dynamically move.

12. A hip flexor bench, consisting of:

an elongated stationary horizontal surface adapted to hold a user in a supine position;

a mounting system secured to an end of the elongated horizontal surface; and a detachable leg stabilization structure detachably secured to the mounting system, the leg stabilization structure comprising:

a base extending parallel along the end of the elongated horizontal surface;

a first vertical support member extending upwardly from the base;

a second vertical support member parallel to first vertical support member and extending upwardly from the base;

a first horizontal member integrally connected to and extending perpendicularly outward from a first end of the first vertical support member;

a second horizontal member integrally connected to and extending perpendicularly outward from a first end of the second vertical support member;

a first rail integrally connected to the first horizontal member and the first vertical support member, the first rail extending in a first vertical plane;

a second rail integrally connected to the second horizontal member and the second vertical support member, the second rail extending in a second vertical plane; and a pad detachably secured between to the first and second rails and adapted to receive a leg of the user; and a movement arm partially rotatable relative to the elongated horizontal surface, the movement arm configured to support a posterior knee of the second leg of the user; and wherein the leg stabilization structure is adapted to provide contralateral stabilization to a lumbar spine of the user; and wherein the leg stabilization structure is adapted to maintain a first leg of the user in a static position while allowing a second leg of the user to dynamically move.

* * * * *